US009381532B2

(12) United States Patent
Bloc et al.

(10) Patent No.: US 9,381,532 B2
(45) Date of Patent: Jul. 5, 2016

(54) DISPENSING HEAD FOR A SYSTEM FOR DISPENSING A PRESSURIZED PRODUCT

(71) Applicants: Richard Bloc, Derchigny-Graincourt (FR); Bernard Clerget, Haudivillers (FR)

(72) Inventors: Richard Bloc, Derchigny-Graincourt (FR); Bernard Clerget, Haudivillers (FR)

(73) Assignee: Albea Le Treport S.A.S., Le Treport (FR)

( * ) Notice: Subject to any disclaimer, the term of this patent is extended or adjusted under 35 U.S.C. 154(b) by 0 days.

(21) Appl. No.: 14/019,227

(22) Filed: Sep. 5, 2013

(65) Prior Publication Data

US 2014/0061251 A1 Mar. 6, 2014

(30) Foreign Application Priority Data

Sep. 5, 2012 (FR) ..... 12 58306

(51) Int. Cl.

| | |
|---|---|
| ***B65D 35/38*** | (2006.01) |
| ***B65D 88/54*** | (2006.01) |
| ***B05B 11/00*** | (2006.01) |
| ***B05B 1/04*** | (2006.01) |

(52) U.S. Cl.

CPC ..... *B05B 11/3047* (2013.01); *B05B 1/04* (2013.01); *B05B 1/046* (2013.01); *B05B 1/048* (2013.01); *B05B 11/3001* (2013.01)

(58) Field of Classification Search

CPC ..... B05B 1/02; B05B 1/04; B05B 1/044; B05B 1/046; B05B 1/048; B05B 11/3001; B05B 11/3043; B05B 11/3045; B05B 11/3047

USPC ..... 222/321.1, 321.7–321.9, 381, 382, 222/383.1, 383.3, 385; 239/597–601

See application file for complete search history.

(56) References Cited

U.S. PATENT DOCUMENTS

| | | | | | |
|---|---|---|---|---|---|
| 3,178,120 | A * | 4/1965 | Kappel | 239/600 |
| 3,415,426 | A * | 12/1968 | Kleveland | 222/402.11 |
| 5,154,325 | A * | 10/1992 | Ryder et al. | 222/189.06 |
| 5,518,377 | A * | 5/1996 | Bougamont et al. | 417/446 |
| 6,030,632 | A * | 2/2000 | Sawan et al. | 424/405 |
| 6,681,961 | B2 * | 1/2004 | Pares Montaner et al. | 222/321.1 |
| 7,886,941 | B2 * | 2/2011 | Pietrowski et al. | 222/494 |
| 2006/0213408 | A1 | 9/2006 | Christ | |

FOREIGN PATENT DOCUMENTS

| | | | | |
|---|---|---|---|---|
| EP | 0580460 | A1 | 1/1994 | |
| EP | 1716928 | A2 | 11/2006 | |
| WO | WO 92/12063 | A1 * | 7/1992 | B65D 25/40 |
| WO | 2011126569 | A1 | 10/2011 | |

OTHER PUBLICATIONS

French Search Report, Application No. FR 1258306, Issued: Jun. 11, 2013, 6 pages.

* cited by examiner

*Primary Examiner* — Nicholas J Weiss
(74) *Attorney, Agent, or Firm* — St Onge Steward Johston and Reens LLC

(57) ABSTRACT

A dispensing head for a system for dispensing a pressurized product, the head including a body having a mounting shaft for the head on a tube for supplying the pressurized product and a channel for dispensing the product between the shaft and an orifice for dispensing the product, the dispensing orifice being formed between two longitudinal walls, upper and lower, respectively, which are connected on either side, respectively, by a lateral wall of which the transverse dimension is smaller than the longitudinal dimension of the longitudinal walls, and each of the lateral walls has a projection that extends between the longitudinal walls, at least the walls of the dispensing orifice including an antimicrobial agent for the product to be dispensed.

16 Claims, 2 Drawing Sheets

DISPENSING HEAD FOR A SYSTEM FOR DISPENSING A PRESSURIZED PRODUCT

FIELD OF THE INVENTION

The invention relates to a dispensing head for a system for dispensing a pressurized product, a dispensing system comprising such a head fixed on a tube for supplying the pressurized product as well as a bottle containing a product to be dispensed under pressure by means of such a dispensing system.

BACKGROUND OF THE INVENTION

In a specific application, the product is of the lotion, gel or cream type, for example, for cosmetic use or for pharmaceutical treatments.

Dispensing systems are known which comprises a pump equipped with a tube for supplying the pressurized product on which a pushbutton-type dispensing head is fixed in order to actuate the movement of said tube over a product dispensing/suction stroke.

In particular, the dispensing head can comprise a body having a mounting shaft for said head on the supply tube and a product dispensing channel between said mounting shaft and a dispensing orifice. Thus, by pressing on the body of the dispensing head, the pump is actuated in order to dispense the product through the dispensing orifice in the form of a drop or a continuous stream.

The dispensing orifice can be formed between two longitudinal walls, upper and lower, respectively, which are connected on either side by a lateral wall of which the transverse dimension is smaller than the longitudinal dimension of the longitudinal walls. Thus, the product is dispensed in the form of a layer that has a longitudinal dimension that is greater than its transverse dimension, in particular with a substantially rectangular cross-section.

Around the world, various directives are intended to regulate, control and limit the presence of substances potentially dangerous for human health in cosmetic products in particular. One of them is the European directive REACh (Registration Evaluation and Authorisation of Chemicals). In addition, an environmental tendency is pushing cosmetologists to limit preservatives and even remove them from their formulas, as they often cause allergies or intolerance.

Cosmetic products are therefore becoming increasingly fragile. In particular, they have difficulty withstanding mechanical or thermal stress (for example, causing a phase change), contact with air (for example, causing drying, oxidation), and are easily contaminated by bacteria, yeast and mould.

To fight this contamination, formulators attempt to reinforce the intrinsic preservative activity of their products by adding ingredients having a preservative activity, such as certain essential oils, orange essences, vitamin C, and so on, which are not declared as preservatives. In addition, they limit the free activity of water, which they attempt to keep low (AW<0.6) to limit or eliminate the development of bacteria. Standard NF 29621 describes such means. However, the formulators quickly come up against the limits of such a strategy.

On the other hand, protective dispensing systems are appearing on the market. In particular, systems have been proposed in which the dispensing channel is not very narrow and not very twisted, so as not to subject the product to pressure during its dispensing. So-called "airless" systems have also been proposed, in which air does not enter in order to compensate for the volume of product dispensed, or in which the entering air is filtered through a mesh on the order of 0.2 μm in order to retain bacteria, yeast and mould.

Systems have also been proposed in which the dispensing orifices is self-closing, thereby limiting contact of the product with air between uses. However, this mechanical self-closing, formed at the interface of two often imperfect shapes, cannot guarantee full retention of bacteria, yeast and mould, which are several dozen micrometres in size.

SUMMARY OF THE INVENTION

To solve these contamination problems, dispensing systems have been proposed using materials containing antimicrobial agents, for example with an organic base such as Trichlosan (trade name of the company Melcoplast) or a silver base, which are located in an area of contact with the product so as to prevent its contamination.

However, these antimicrobial agents act by contact and/or by diffusion in the product and therefore are effective only on a product layer of reduced thickness, i.e. having a low maximum distance between the product and the antimicrobial contact areas.

To preserve a sufficient dispensed product dose, the longitudinal dimension of the layer must then be increased, which leads to the dispensing of a layer of which the appearance is not satisfactory, in particular having insufficient mechanical strength.

The invention is intended to improve on the prior art by proposing, in particular, a system for dispensing a product layer that is satisfactory with respect to the dose of product dispensed and its appearance, said system making it possible to act effectively against contamination by bacteria, yeast and mould of said layer.

In addition, the invention proposes a dispensing system with an improved antimicrobial property so as to be capable of dispensing products of which the preservative content is limited or even nil. Consequently, the combined use of a dispensing system according to the invention with a bottle containing such a product is particularly advantageous.

The combined use of a dispensing system according to the invention with a bottle containing a product to be dispensed is also particularly advantageous when the intrinsic preservative activity of said product is improved, for example, by adding ingredients having a preservative activity such as certain essential oils, orange essences, vitamin C and/or by limiting the free activity of water (AW<0.6).

To achieve these differing improvements, according to a first aspect, the invention proposes a dispensing head for a system for dispensing a pressurized product, said head comprising a body having a mounting shaft for said head on a tube for supplying the pressurized product and a channel for dispensing the product between said shaft and an orifice for dispensing said product, said dispensing orifice being formed between two longitudinal walls, upper and lower, respectively, which are connected on either side, respectively, by a lateral wall of which the transverse dimension is smaller than the longitudinal dimension of the longitudinal walls, each of the lateral walls having a projection that extends between the longitudinal walls, at least the walls of the dispensing orifice comprising an antimicrobial agent for the product to be dispensed.

According to a second aspect, the invention proposes a system for dispensing a pressurized product, said system comprising such a dispensing head and a tube for supplying the pressurized product on which the mounting shaft for said head is fixed.

According to a third aspect, the invention proposes a bottle containing a product to be dispensed under pressure, said bottle comprising a neck on which such a dispensing system is associated so as to place the supply tube in communication with the product in order to enable the product to be routed from said supply tube to the dispensing orifice.

BRIEF DESCRIPTION OF THE DRAWINGS

Other objectives and advantages of the invention will appear in the following description, provided with reference to the appended figures, wherein.

DETAILED DESCRIPTION OF THE INVENTION

Figure 1:
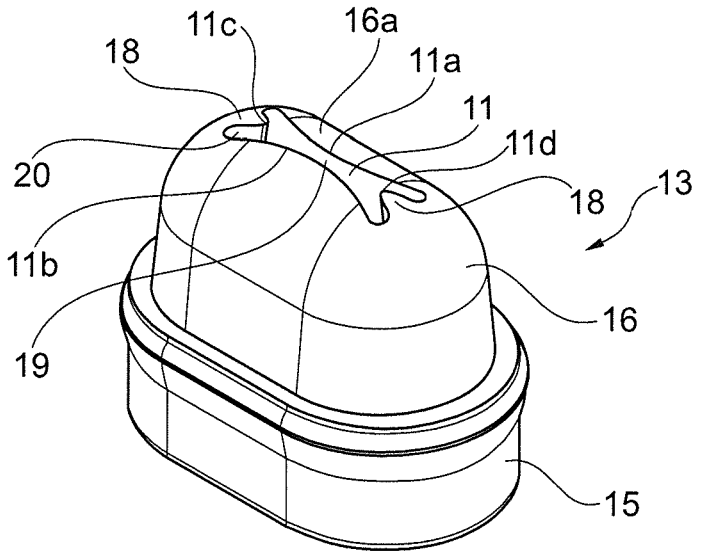
FIG. 1 is a perspective view of a nozzle for a dispensing head according to an embodiment of the invention.
Figure 2A:
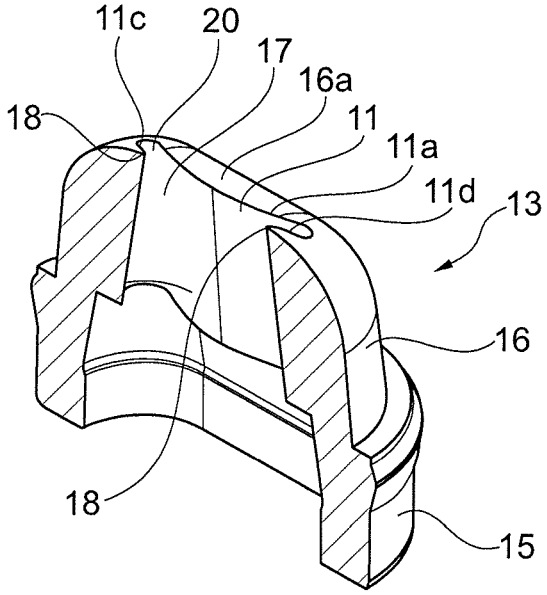
FIGS. 2*a*-2*b* are longitudinal cross-section (FIG. 2*a*) and transverse cross-section (FIG. 2*b*) views, respectively, of the nozzle of FIG. 1.
Figure 2B:
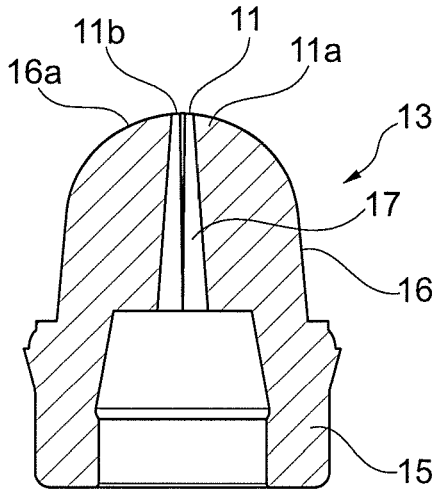
Figure 3A:
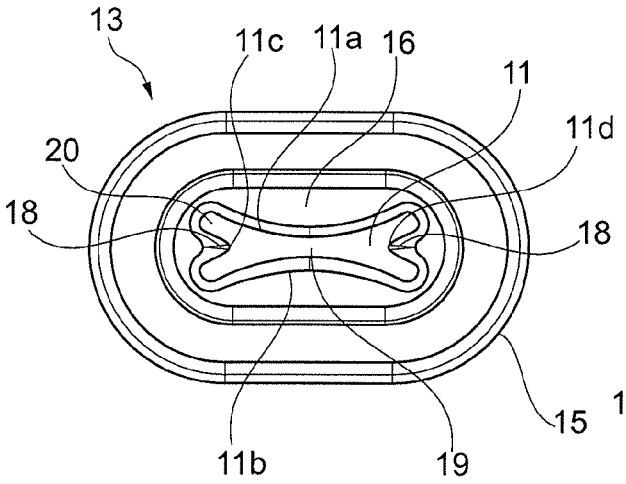
FIGS. 3*a*-3*b* are bottom (FIG. 3*a*) and top (FIG. 3*b*) views, respectively, of the nozzle of FIG. 1.
Figure 3B:
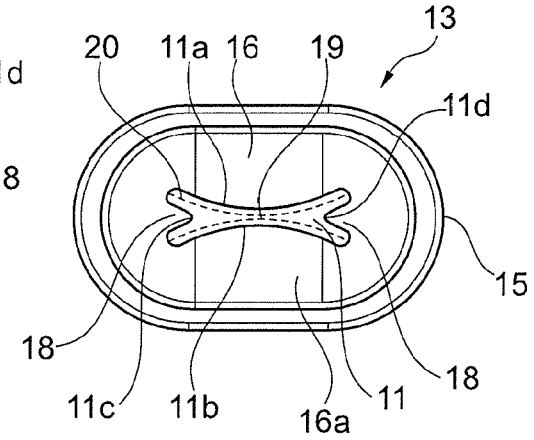

In relation to the figures, a dispensing system is described which comprises a pump 1 actuated by a dispensing head 2 of the pushbutton type so as to enable a pressurized product to be dispensed, for example, in the form of a drop or a continuous stream.

To do this, the dispensing system is mounted on a bottle 3 containing the product to be dispensed under pressure. In an example of application, the product is a lotion, a gel or a cream, for cosmetic use or for pharmaceutical treatments.

The bottle 3 comprises a body 4 on which a neck 5 is mounted and the dispensing system comprises a fixation band 6 on which the pump 1 is mounted, said band being associated with the neck 5 so as to put the pump 1 in sealed communication with the product packaged in said body.

Figure 4A:
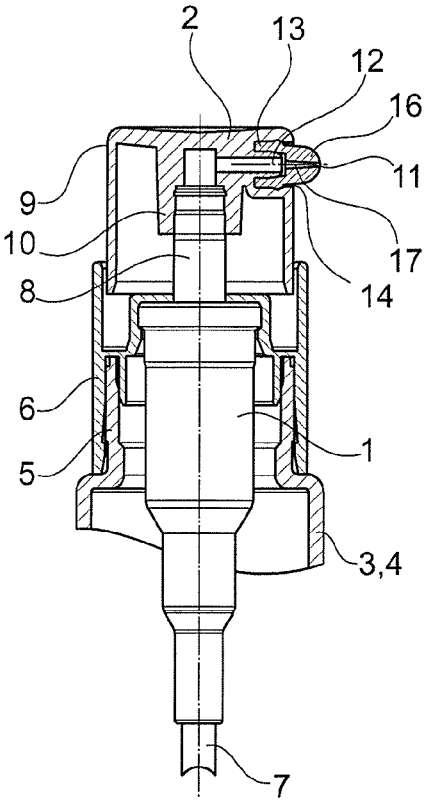
FIGS. 4*a*-4*b* are partial views of a bottle equipped with a dispensing system according to an embodiment of the invention, in a longitudinal cross-section (FIG. 4*a*) and side (FIG. 4*b*) view.
Figure 4B:
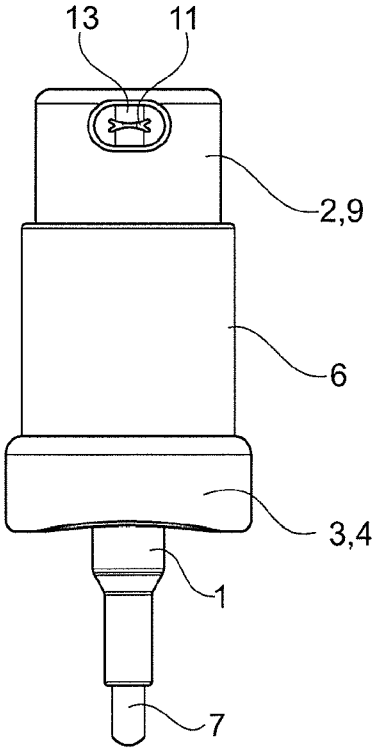

In FIG. 4*a*, the pump 1 is not cut, but classically comprises a body in which the means necessary for pressurizing the product to be dispensed are arranged. According to a particular embodiment, the pump 1 is of the type that does not take in air to compensate for the volume of product dispensed, so as not to introduce contaminants into the bottle 3 and therefore into the packaged product.

The invention is not limited to a specific pump structure 1 or to a particular way of mounting the pump 1 onto the bottle 3. In addition, the pump 1 can be supplied with product packaged by means of a plunger tube 7 arranged in the bottle 3 or by means of a piston for supplying the product that is slidingly mounted in the body 4 so as to push the product into the pump 1.

The pump 1 comprises a tube 8 for supplying the pressurized product, said tube being capable of being moved in reverse over a product dispensing/suction stroke. To actuate this movement, the dispensing head 2 is mounted on the downstream portion of the supply tube 8, said head comprising a body 9 having a mounting shaft 10 for said head on said supply tube and a product dispensing channel between said shaft and a dispensing orifice 11.

In the embodiment shown, the dispensing channel has a downstream passage 12 that is equipped with a nozzle 13 in which the dispensing orifice 11 is formed. In particular, the dispensing head 2 has a housing 14 into which the downstream passage 12 leads, the nozzle 13 comprising a mounting duct 15 that is fixed in a sealed manner in said housing, the interior of said duct being arranged on the downstream passage 12. In addition, the duct 15 is extended by a front end-piece 16 formed in a single piece, a supply conduit 17 of the dispensing orifice 11 being formed in said end-piece.

Thus, by fixing the mounting shaft 10 on the supply tube 8, the dispensing of the product is performed by pressing on the body 9 in order to actuate the movement of said tube so as to route the packaged product from the supply tube 8 to the dispensing orifice 11 by means of the downstream passage 12, the duct 15 and the supply conduit 17.

The dispensing system can also be used for other types of dispensing. In particular, the bottle 3 can comprise a flexible body 4, the pressurization of the product in the supply tube 8 being achieved then by bringing the walls of said bottle together, without implementing a pump.

The dispensing orifice 11 is formed between two longitudinal walls, upper 11*a* and lower 11*b*, respectively, which are connected on either side by a lateral wall 11*c*, 11*d*, respectively. The transverse dimension of the lateral walls 11*c*, 11*d* is smaller than the longitudinal dimension of the longitudinal walls 11*a*, 11*b* in order to dispense the product in the form of a layer that has a longitudinal dimension that is greater than its transverse dimension.

In the embodiment shown, the longitudinal walls 11*a*, 11*b* and lateral walls 11*c*, 11*d* extend in the end-piece 16 to form the supply conduit 17, said conduit narrowing toward the dispensing orifice 11. Thus, the supply conduit 17 has a cross-section identical in shape to that of the dispensing orifice 11, the flow of pressurized product being pushed into said conduit so as to be dispensed in the form of a layer of which the cross-section is equivalent to that of the dispensing orifice 11.

Each of the lateral walls 11*c*, 11*d* has a projection 18 that extends between the longitudinal walls 11*a*, 11*b*, at least the walls 11*a*-11*d* of the dispensing orifice 11 comprising an antimicrobial agent for the product to be dispensed. Thus, a rigidification of the layer is combined by means of lateral projections 18 with an action against anti-contamination of the product by said layer by bacteria, yeast and mould.

In particular, the decontamination is ensured of the product, which, between two uses, is located in the vicinity of the dispensing orifice 11, and the penetration of bacteria, yeast and mould into the bottle 3 is prevented by means of the dispensing channel.

Advantageously, the exterior surface 16*a* of the front end-piece 16 in which the dispensing orifice 11 is formed can also comprise an antimicrobial agent. Thus, soiling contamination on this surface 16*a* between two uses, in particular by spreading of said product during its collection by the user's finger, is prevented, thereby ensuring that the dispensed product is not subsequently contaminated by said soiling.

Similarly, the dispensing channel and in particular the supply conduit 17 in which the product is immobilized between two uses can comprise an antimicrobial agent, in particular having a volume smaller than 0.1 $mm^3$ in order to limit the maximum distance separating said agent from the product in order, by surface effect on a very small volume of product, to ensure decontamination of the product contained in said volume.

The projections 18 are arranged so as to prevent the layer from rolling over itself during dispensing and to increase the contact surface between the product forming the layer and the antimicrobial agent. In particular, the projections 18 are arranged inside lateral edges of the layer so as to improve the efficacy of the antimicrobial action by limiting the maximum distance between the product contained within said edges and the antimicrobial agent.

In addition, the presence of projections 18 makes it possible to increase the transverse dimension of the lateral walls 11*c*, 11*d* and therefore of the lateral edges of the layer so as, in particular, to preserve a dispensing orifice 11 of which the passage cross-section is large enough for the product dose to be dispensed, without altering the appearance and action of decontamination of the layer.

According to the embodiment shown, the longitudinal walls 11*a*, 11*b* are convex toward the interior of the dispensing orifice 11 so as to limit the transverse dimension of the central passage 19, which is formed between said longitudinal walls. Thus, a good action against contaminations of the product dispensed through the central passage 19 is guaranteed, while the transverse dimension of the edges of said layer are increased in order to preserve a passage cross-section that is large enough for the dose to be dispensed.

In addition, each lateral wall 11*c*, 11*d* has an upper portion lower portion, respectively for connection of the projection 18 with the longitudinal upper wall 11*a* lower wall 11*b*, respectively. Thus, in the dispensing orifice 11, the following are formed:

a central passage 19 between the longitudinal walls 11*a*, 11*b*, said central passage having a reduced transverse dimension in order to promote the antimicrobial action on the product dispensed through it;

four lateral passages 20 between the longitudinal walls 11*a*, 11*b* and the projections 18, said lateral passages having a reduced dimension in order to promote the antimicrobial action on the product dispensed through them, while contributing to the increase in the cross-section of the dispensing orifice 11.

In the embodiment shown, each portion of the lateral walls 11*c*, 11*d* is rounded to form a lateral passage 20 with a lobe shape between each of the longitudinal walls 11*a*, 11*b* and a projection 18.

Advantageously, the maximum transverse dimension of the dispensing orifice 11 between the longitudinal walls 11*a*, 11*b* is less than or equal to 0.5 mm, i.e. the maximum distance between the antimicrobial agent and the product dispensed through the central passage 19 is less than 0.25 mm. Similarly, the maximum transverse dimension of the dispensing orifice 11 between the longitudinal walls 11*a*, 11*b* and the projections 18 can be less than or equal to 0.5 mm so that the maximum distance between the microbial agent and the product dispensed through the lateral passages 20 is less than 0.25 mm. Thus, by surface effect on a very thin film of product, the decontamination of the product contained in the dispensing orifice 11 is ensured.

According to an advantageous embodiment, at least the walls 11*a*-11*d* of the dispensing orifice 11 comprise metallic copper, which, owing to its microbiostatic properties, prevents the proliferation or even eliminates contaminants in contact with said walls, without migration of any antimicrobial agent into the product.

Advantageously, the nozzle 13 comprises metal copper, in particular by being made of metallic copper or a synthetic material, for example, of the polyolefin type, which is metalized and/or filled with metallic copper.

According to another embodiment, at least the walls 11*a*-11*d* of the dispensing orifice 11 are based on a material comprising an antimicrobial agent, in particular a microbiostatic and/or microbiocidal agent, for example, with an organic base such as Trichlosan (trade name of the company Melcoplast) or with a silver base.

What is claimed is:

1. A dispensing head for a system for dispensing a pressurized product, said head comprising a body having a mounting shaft for mounting said head on a tube for supplying the pressurized product and a channel for dispensing the product between said shaft and an orifice for dispensing said product, said dispensing orifice being formed between two longitudinal walls, upper and lower, respectively, which are connected on either side, respectively, by a lateral wall of which a transverse dimension is smaller than a longitudinal dimension of the longitudinal walls, said dispensing head being characterized in that each of the lateral walls has a projection that extends between the longitudinal walls, at least the walls of the dispensing orifice comprising an antimicrobial agent for the product to be dispensed, wherein each lateral wall has an upper portion—lower portion, respectively—for connecting the projection with the longitudinal upper wall—lower wall, respectively, so as to form, in the dispensing orifice four lateral passages and a central passage.

2. The dispensing head according to claim 1, characterized in that each of the upper and lower portions is rounded so as to form the lateral passages in the form of a lobe between each of the longitudinal walls and the projection.

3. The dispensing head according to claim 1, characterized in that the longitudinal walls are convex toward the interior of the dispensing orifice.

4. The dispensing head according to claim 1, characterized in that a maximum transverse dimension of the dispensing orifice between the longitudinal walls is less than or equal to 0.5 mm.

5. The dispensing head according to claim 1, characterized in that a maximum transverse dimension of the dispensing orifice between the longitudinal walls and the projections is less than or equal to 0.5 mm.

6. The dispensing head according to claim 1, characterized in that at least the walls of the dispensing orifice comprise metallic copper.

7. The dispensing head according to claim 1, characterized in that at least the walls of the dispensing orifice are made based on a material containing an antimicrobial agent.

8. The dispensing head according to claim 1, characterized in that the dispensing channel has a downstream passage, which is equipped with a nozzle in which the dispensing orifice is formed.

9. The dispensing g head according to claim 8, characterized in that the nozzle comprises a mounting duct on the downstream passage, said duct being extended by the front end-piece in which a conduit for supplying the dispensing orifice is formed.

10. The dispensing head according to claim 9, characterized in that the longitudinal and/or lateral walls extend into the front end-piece to form the supply conduit.

11. The dispensing head according to claim 9, characterized in that the supply conduit narrows toward the dispensing orifice.

12. A system for dispensing a pressurized product, said system comprising such a dispensing head according to claim 1 and a tube for supplying the pressurized product on which the mounting shaft for said head is fixed.

13. The system according to claim 12, characterized in that it comprises a pump actuated by the dispensing head, said pump comprising the tube for supplying the pressurized product.

14. A bottle containing a product to be dispensed under pressure, said bottle comprising a neck on which such a dispensing system according to claim 12 is associated so as to place the supply tube in communication with the product in order to enable the product to be routed from said supply tube to the dispensing orifice.

15. A bottle containing a product to be dispensed under pressure, said bottle comprising a neck on which such a dispensing system according to claim 13 is associated so as to place the supply tube in communication with the product in order to enable the product to be routed from said supply tube to the dispensing orifice.

16. The dispensing head according to claim 10, characterized in that the supply conduit narrows toward the dispensing orifice.

* * * * *